United States Patent [19]

Gehrmann et al.

[11] Patent Number: 5,008,992

[45] Date of Patent: Apr. 23, 1991

[54] METHOD OF PRODUCING A BULKED COMPOSITE YARN

[75] Inventors: Bernd Gehrmann, Schwelm; Heinz Treptow, Ennepetal-Milspe, both of Fed. Rep. of Germany

[73] Assignee: Barmag AG, Remscheid, Fed. Rep. of Germany

[21] Appl. No.: 420,571

[22] Filed: Oct. 12, 1989

[30] Foreign Application Priority Data

Oct. 15, 1988 [DE] Fed. Rep. of Germany ..... 3835138
Dec. 10, 1988 [DE] Fed. Rep. of Germany ..... 3841740

[51] Int. Cl.[5] ..... D02G 1/20

[52] U.S. Cl. ..... 28/271; 28/252; 28/283; 57/239

[58] Field of Search ..... 28/271, 282, 283; 57/239, 337, 338, 908, 205

[56] References Cited

U.S. PATENT DOCUMENTS 3,940,917 3/1976 Strachan ..... 28/271 X
3,952,496 4/1976 Nagel et al. ..... 57/208 X
3,991,548 11/1976 Toromyi et al. ..... 57/205
4,341,063 7/1982 Southerlin et al. ..... 28/271 X
4,829,757 5/1989 Canton ..... 28/252 X

FOREIGN PATENT DOCUMENTS 269184 6/1988 European Pat. Off. ..... 28/271
GM 7520319 1/1976 Fed. Rep. of Germany .
49367 4/1977 Japan ..... 57/908

*Primary Examiner*—Werner H. Schroeder
*Assistant Examiner*—John J. Calvert
*Attorney, Agent, or Firm*—Bell, Seltzer, Park & Gibson

[57] ABSTRACT

A method for combining a relatively elastic yarn component with a relatively inelastic yarn component is disclosed, and wherein the two components are guided through a jet of high velocity air so as to entangle the filaments and produce a bulked composite yarn. To facilitate the air jet entangling operation, at least the inelastic yarn component is subjected to a filament spreading operation prior to its advance through the air jet. The method may also be incorporated in a false twisting process, and wherein the inelastic component is false twisted so as to transversely spread its filaments prior to its being brought into contact with the elastic component and subjected to the air jet.

26 Claims, 3 Drawing Sheets

METHOD OF PRODUCING A BULKED COMPOSITE YARN

BACKGROUND OF THE INVENTION

The present invention relates to a method for producing a bulked composite yarn composed of an inelastic yarn component and an elastic yarn component. A process of this general type is disclosed in U.S. Pat. No. 3,940,917.

In a known process of the described type, a thermoplastic yarn, i.e., a filamentary yarn having a relatively low elasticity, is brought together with a spandex elastic yarn which has a comparatively high elasticity of for example more than ten times that of the inelastic yarn component. The two yarn components are then guided through an air nozzle and withdrawn therefrom in a manner such that the overfeed of the relatively inelastic yarn component is zero. The resulting composite yarn is characterized by having the filaments of the inelastic yarn component entangled about the elastic yarn component in intermittent zones of entanglement which are separated by relatively non-entangled zones. This process has the disadvantage that the air jet treatment can only provide for the desired intensive and uniform combination of the two components when the two components are guided through the air jet at a relatively slow speed, or when a particularly intensive air jet treatment is employed which involves a high pressure and a high throughput of the air.

It is an object of the present invention to provide a method of the described type wherein a high quality composite yarn with intensive entanglement of the individual filaments is produced, and which is carried out at high yarn speeds and low energy consumption.

SUMMARY OF THE PRESENT INVENTION

The above and other objects and advantages of the present invention are achieved in the embodiments illustrated herein by the provision of a method which comprises the steps of advancing the elastic and the inelastic yarn components along respective paths of travel, while guiding the advancing components through a jet of high velocity fluid so that the jet impinges on the two components and entangles the filaments and combines the two yarn components to form a composite yarn. Also, and significantly, the method includes a spreading of the filaments of the advancing inelastic yarn component prior to its being guided through the fluid jet.

In the method of the present invention, the elasticity of the elastic yarn component is greater than that of the inelastic yarn component, preferably by a factor of about ten. Also, while the spreading step relates in particular to the thermoplastic yarn component, i.e. the relatively inelastic yarn component, the spreading step can also apply to both yarn components, especially when the spreading step occurs after the two yarns are brought together.

The spreading step serves to cause the air in the air treatment jet to be more effective, so that a more intense entanglement is produced. However, contrary to all expectations, the average spacing of the entanglement zones becomes shorter and more uniform with the present invention, so that at high speeds of the yarn advance there is no risk that unacceptably long yarn lengths will be produced without entanglement zones.

In one preferred embodiment, the spreading step includes drawing the advancing inelastic yarn component over an edge surface while under tension. In another embodiment, a spreading step includes false twisting the advancing inelastic yarn component before it is brought together with the elastic component. In so doing, the combination with the elastic yarn component occurs while or after the false twist is removed. The removal of the false twist, especially when the false twisting operation is associated with an advancement of the yarn, results in the individual filaments being separated from each other and that the inelastic yarn component becomes more voluminous. Thus a spreading of the individual filaments results within the meaning of the term as employed in the present application, and the present invention makes it possible to integrate the method into a false twist texturing process of the thermoplastic, relatively inelastic yarn component.

False twist texturing is presently carried out at yarn speeds, which are above 600 and also above 800 meters per minute. For this reason, it has been considered impossible to produce a composite yarn of the described type simultaneously on a false twist texturing machine. However, it has been shown that the removal of the false twist results in a pretreatment of the thermoplastic yarn component which includes a spreading effect, which furnishes a very favorable precondition for the production of the composite yarn, and that the production of the composite yarn can thus be integrated into the texturing process of the thermoplastic yarn component. The thermoplastic yarn component is preferably withdrawn from the false twist unit in the false twisting zone under a tension ranging from 0.2 to 0.6 cN/dtex. When employing this combined embodiment, it has also been found that the yarn properties improve substantially and a more uniform appearance is obtained, in particular with respect to the processing of hosiery yarn.

As indicated above, the spreading step may involve a mechanical contact with the yarn. However, when a mechanical contact is not desired for textile reasons, or opposes the achievement of high yarn speeds in the production of the composite yarn, the spreading may be obtained using a fluid nozzle. A suitable fluid nozzle is disclosed, for example, in the not yet published German application P 38 35 169.2. However, this does not preclude that other fluid nozzles, in particular air nozzles, also provide an adequate separation of the individual filaments and a spreading within the meaning of the present application. The aforesaid nozzle has the advantage that the spreading occurs substantially in one plane, and that the expenditure with respect to the pressure and the air quantity is low.

The spreading step can occur with the thermoplastic inelastic yarn component alone, or after its combination with the elastic yarn component. Also, the elastic yarn component may be combined with the inelastic yarn component in a tensioned condition. Preferably the yarn tension is imparted by a defined feed and wherein the elastic yarn component is unwound from a supply package, which is driven at a defined, constant circumferential speed. In so doing, it is preferred that the composite yarn be overfed to the air jet treatment zone, and that the yarn tension be maintained constant during the treatment by the air jet by means of a feed system which precedes the winding system and which controllably withdraws the composite yarn from the jet treatment zone. The relaxation in the air treatment zone allows a high elasticity and a significant bulk (crimp) to be imparted to the composite yarn, with a good covering strength and a great wearing comfort, and primarily, however, an intensive intermingling and entangling of the previously spread filaments. Contributing thereto also is the specific air treatment provided in the treatment zone, and which is effected by one or two air jets which are directed transversely onto the components, and with the jets having a directional component in the direction of the advance of the components.

The fact that the yarn is advanced by a positively driven feed system between the air jet treatment and the winding takeup, makes it possible to produce a package with the desired hardness and without adversely affecting the yarn properties to be achieved by the air treatment. In addition, fluctuations in the yarn tension, which are caused by the takeup, do not become noticeable as a disturbing factor of the yarn properties.

BRIEF DESCRIPTION OF THE DRAWINGS

Some of the objects and advantages of the present invention having been stated, others will appear when considered in conjunction with the accompanying schematic drawings, in which.

DETAILED DESCRIPTION OF THE PREFERRED EMBODIMENTS

Figure 1:
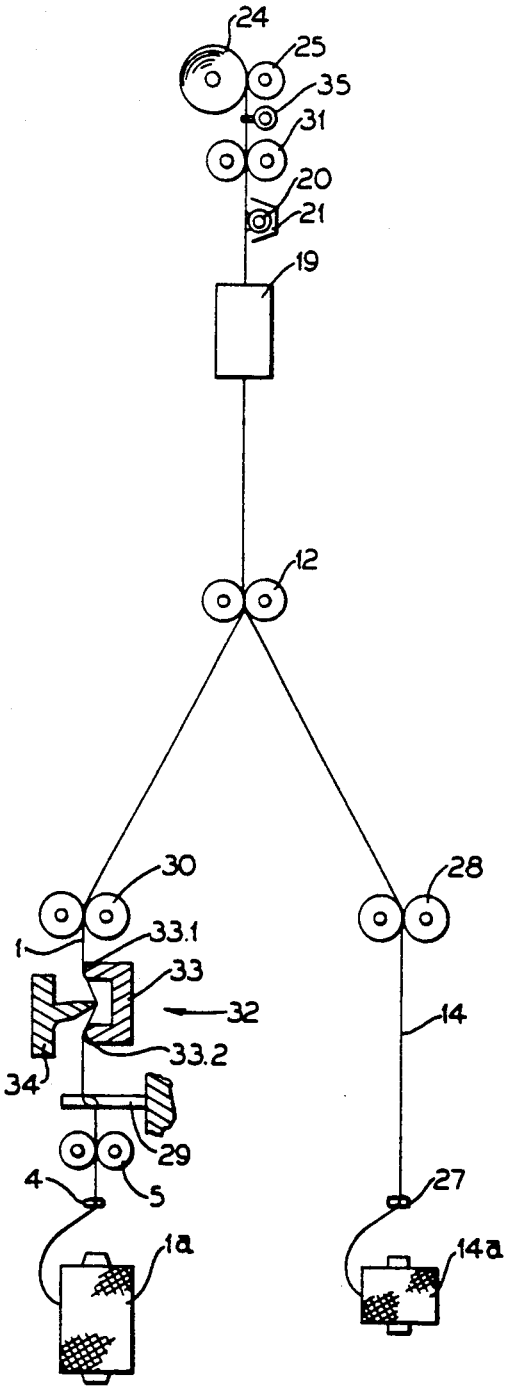
FIG. 1 is a view illustrating the process of the present invention and which involves spreading the inelastic yarn component by contact with an edge.
Figure 2:
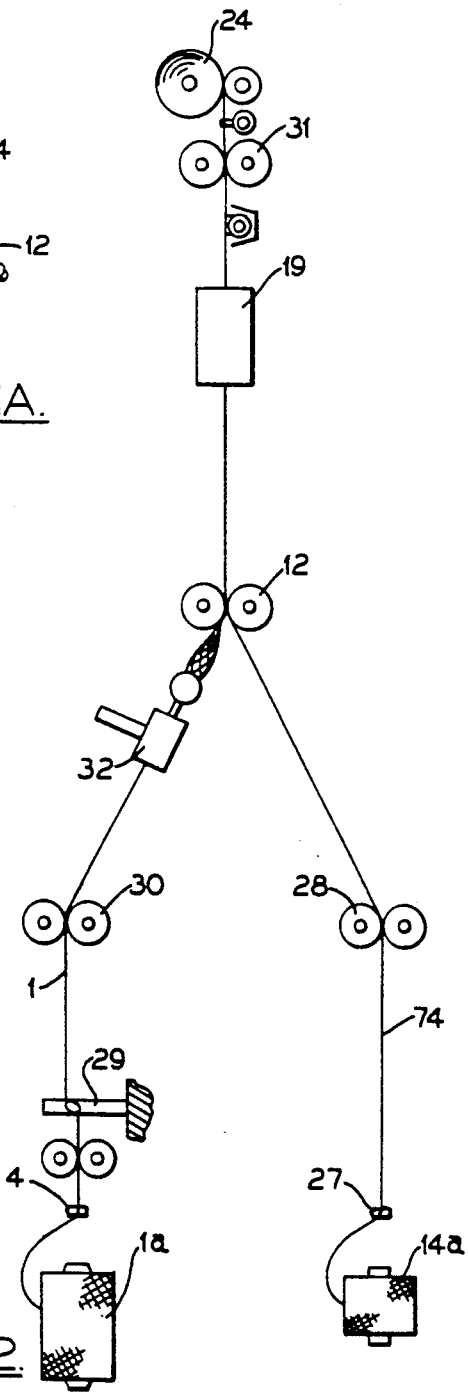
FIG. 2 is a view of a second embodiment of the present invention, and wherein the spreading step is effected by a nozzle.
Figure 3:
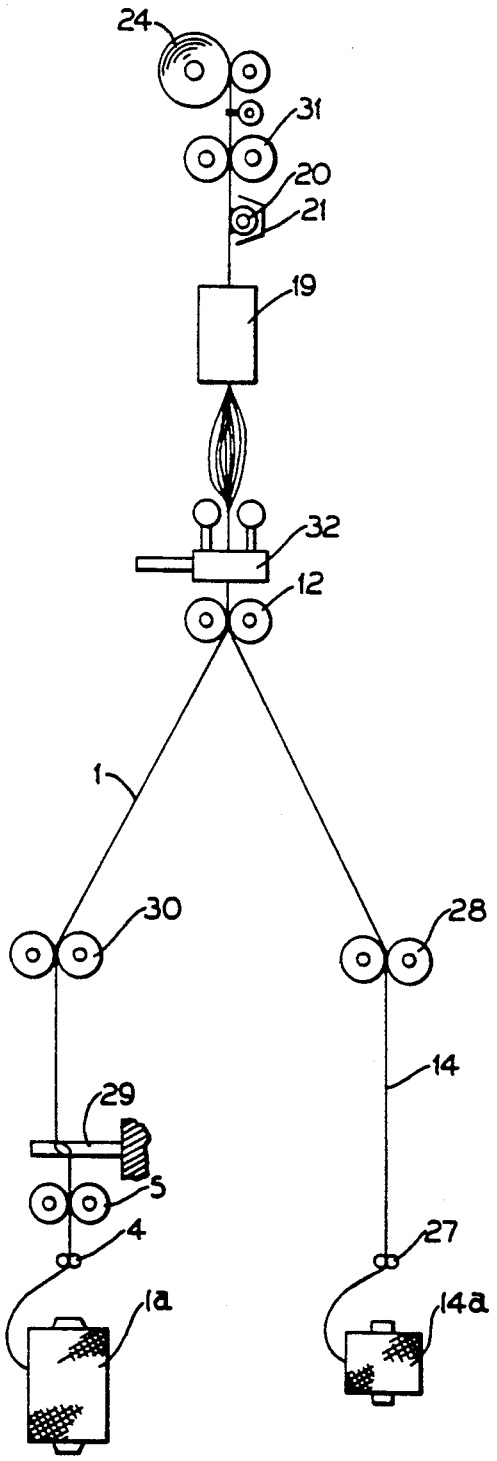
FIG. 3 is a view of another embodiment wherein the spreading step is effected on the yarn components after they have been brought together.

In the embodiments of the method shown in FIGS. 1–3, an elastic yarn component 14 is unwound overhead from a supply package 14*a*, and a relatively inelastic yarn component 1 is withdrawn from a package 1*a*. The elastic yarn component 14 is preferably a highly elastic spandex yarn composed of one or more continuous filaments, and the inelastic yarn component 1 is a multifilament yarn of a thermoplastic material, such as nylon, or polyester. Preferably, the elasticity of the elastic yarn component is at least about ten times that of the inelastic yarn component.

Figure 1A:
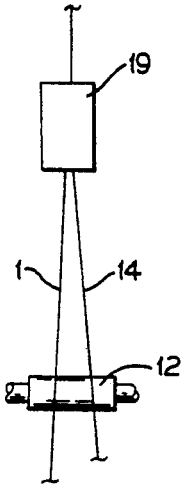
FIG. 1A is a side view of a portion of the apparatus shown in FIG. 1.

A yarn guide 27 is arranged coaxially to the supply package 14*a*, and a similar yarn guide 4 is arranged coaxially to the supply package 1*a*. The elastic yarn component is withdrawn by a feed system 28 and then advanced to a delivery roll system 12. The thermoplastic yarn component 1 is unwound from the supply package 1*a* and guided through the yarn guide 4 by means of a feed system 5. The yarn component 1 then loops 360° about a draw pin 29, and is withdrawn from the draw zone by a draw roll system 30 to then be likewise advanced to the delivery system 12. Although the yarn components are both withdrawn by the delivery system 12, they are preferably guided separately from each other, as is shown in FIG. 1A.

Following the delivery system 12, the yarn components are brought together and guided through an air jet entangling nozzle 19, and withdrawn therefrom by a delivery roll system 31. In this regard, the components are preferably brought together only after or immediately before they enter the nozzle 19. Subsequently, the resulting composite yarn is wound on a package 24, which is rotatably driven on its circumference by a drive roll 25. Prior to being wound onto the package 24, the composite yarn passes over an oiling roll 20 which is positioned in an oil tank 21, and then through the yarn delivery roll system 31. Schematically indicated at 35 is a conventional yarn traversing system.

In the illustrated embodiments of FIGS. 1–3, the method of the invention proceeds as follows. The thermoplastic yarn component 1 is drawn between the feed system 5 and the draw system 30. In so doing, the draw point or draw zone forms on or after the draw pin 29. The circumferential speed of the delivery system 28 for the elastic yarn component is adjusted to the circumferential speed of the delivery system 12, so that both the thermoplastic yarn component and the elastic yarn component advance to the delivery system in a tensioned condition, with the tension of the elastic yarn component being preferably between 0.1 and 0.3 cN/dtex, whereas the tension of the thermoplastic, low-elasticity yarn component ranges from 0.2 to 0.8 cN/dtex.

The circumferential speed of the delivery roll system 31 for the resulting composite yarn is at least 2% and preferably 6% to 9%, less than the circumferential speed of the delivery system 12.

While the methods shown in FIGS. 1–3 differ from each other by the spreading treatment, the latter serves in all embodiments to loosen the fiber assembly of the individual filaments of the inelastic yarn component, which is held together by adhesive and cohesive forces.

In the method of FIG. 1, the spreading treatment occurs in the draw zone. A yarn guide 33 with two contact edges 33.1 and 33.2 and a blade 34 which projects between the two contact edges 33.1 and 33.2, serves as a spreading device. The yarn is guided between the contact edges 33.1 and 33.2 and the blade, thereby being tensioned and spread along the edge of the blade.

In the method of FIG. 2, the spreading device comprises a nozzle 32, as is described in more detail in the aforesaid patent application P 38 35 169.2 and as described below with respect to FIG. 5. Also, the two yarn components are preferably guided separately through the delivery system 12, as seen in FIG. 1A.

In the method of FIG. 3, a nozzle 32 is likewise provided to serve as the spreading device. However, the nozzle 32 of this embodiment is arranged directly before the entangling nozzle 19 for the treatment by an air jet.

Figure 4:
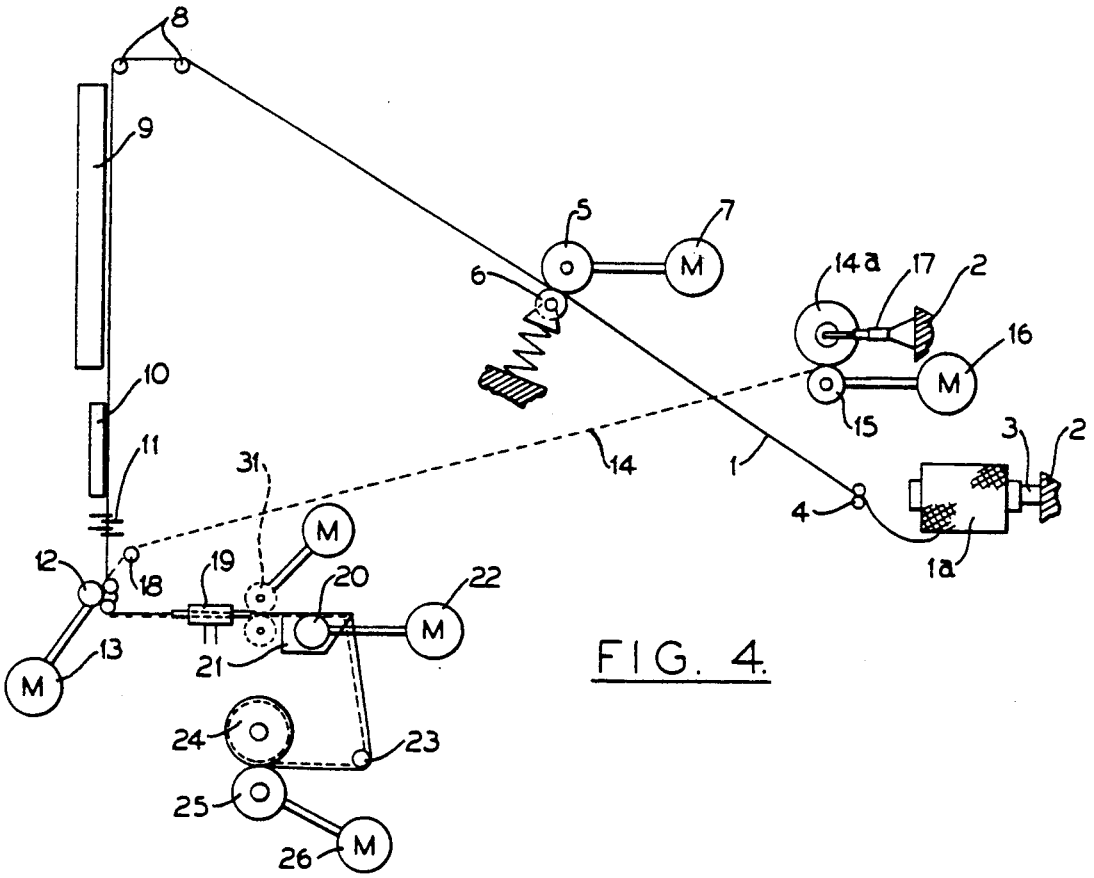
FIG. 4 is a view of still another embodiment integrated into a false twist texturing process.

In the embodiment of FIG. 4, the method of the present invention is integrated into a false twist operation. In particular, a supply package 1*a* with a thermoplastic yarn component 1, is creeled on a pin 3 of a creel 2 which is shown in part. The yarn component 1 is guided through a centrally arranged yarn guide 4 and withdrawn by a feed system 5. The feed system 5 is driven by a motor 7. As it passes through the feed system 5, the yarn component is pressed by a contact roll 6, which is biased by a spring against the surface of the feed system 5. Subsequent to the deflecting guides 8, the yarn component is guided over a heater plate 9 and a subsequent cooling plate 10 before it enters into a false twist unit 11, which in the illustrated embodiment is a friction false twist apparatus comprising a plurality of rotating disks. A feed system 12 withdraws the yarn component from the false twist zone. The feed system 12 is driven by a motor 13. The yarn component is pressed against the surface of the feed system 12 by means of an apron looped about two freely rotatable rolls.

The elastic yarn component 14 is wound on a supply package 14*a*, and which is supported on a rocking arm 17 and rests with its circumference on a drive roll 15. The drive roll 15 is driven by a motor 16 in such a manner that the elastic yarn component is unwound. The elastic yarn component is guided over a deflecting roll 18 separated from and parallel to the thermoplastic yarn into the feed system 12.

Only in or preferably after the feed system 12, the yarn components are brought together, and they then enter into the air nozzle 19, which is an entanglement nozzle. The two components are guided into the nozzle 19 at the same speed, and preferably they are separated from each other in the manner shown in FIG. 1A. The function of the entangling nozzle is to form entanglements between the individual filaments of the two yarn components which recur in a more or less regular sequence. Behind the entangling nozzle 19, the now combined composite yarn is guided over an oiling roll 20, which is driven by a motor 22 at a slow speed. Subsequently, the yarn advances over a deflecting guide 23 and through a traversing system (not shown) to a takeup package 24. The package 24 rests on drive roll 25, which is driven by motor 26 at a defined speed. Preferably, a delivery system 31 as indicated in dashed lines is arranged between the entangling nozzle 19 and the takeup package 24. The speed of the delivery system 31 is adjustable irrespective of the speed of the other yarn feed systems and drive rolls 15 and 25 respectively.

The thermoplastic yarn component used in the present method may be partially oriented, and it is drawn between the feed systems 5 and 12. Consequently, the feed systems 12 and 5 are driven at a speed ratio of 1.1:1 up to 2:1, with a yarn tension of 0.3 to 0.8 cN/dtex developing before the feed system 12. The drive roll 15 of the supply package for the elastic yarn component is driven at a circumferential speed which is clearly less than that of feed system 12. The speed ratio ranges from 1:2 to 1:4. As a result, the tension of the elastic yarn component ranges from 0.1 to 0.4 cN/dtex before the feed system 12.

When the delivery system 31 is absent, the speed of drive roll 25 for the package 24 is lower, such as 4% to 10%, and preferably 6% to 9%, than the speed of the feed system 12. However, the speed of the composite yarn immediately following its being guided through the nozzle 19 is substantially greater than, and preferably more than twice, the speed at which the elastic yarn component is withdrawn from its supply package. If a delivery system 31 is provided, these speed ratios will apply to the feed system 12 and the delivery system 31. The relative yarn tension at the takeup is very low, since the tensile forces are here taken up only by the portion of the elastic yarn component in the composite yarn. However, the denier is substantially equal to the sum of the individual filaments. The drop of the relative yarn tension results from the fact that the absolute tension of the elastic yarn component before the feed system amounted to 7 cN in one example, whereas the absolute tension of the composite yarn behind the entangling nozzle was 5 cN.

Between the feed system 12 and the takeup, it is also possible to guide the yarn through a heating system before the air nozzle, or preferably after the nozzle and before the delivery system 31, so as to smooth the tendency of the previously twisted thermoplastic yarn to twist.

A special feature of the method of the present invention is that the yarn components are brought together only in or shortly before the entangling nozzle. If this is not so, the two yarn components will end up in a combination, which is caused by the tendency of the previously false twisted yarn to crimp and thereby disturb the appearance of the composite yarn. On the other hand, it has been shown that the bringing together of the elastic yarn component and the thermoplastic yarn component should occur as late as possible, preferably only after the feed system at the end of the false twist zone, if a combination of the two yarns by the tendency to crimp of the thermoplastic yarn is to be avoided.

The friction false twister 11 may be of the type shown in U.S. Pat. No. 3,813,868, or U.S. Pat. No. 4,339,915, or U.S. Pat. No. 4,377,932. These false twisters apply frictional forces to the filaments transversely to the axis of the yarn component. Also, the frictional forces act not only to rotate the filaments around the axis of the component, but also to spread the filaments transversely to the axis and to loosen the interconnection between the filaments.

Finally, it has also be found that the thermoplastic yarn component must be supplied to the entangling nozzle at a speed which leads to an extensive relaxation of the thermoplastic yarn in the combining zone. If not, the thermoplastic, low-elasticity yarn will not participate in the interlacing and entangling by the air jet treatment, and the intermingling and entangling of the yarns will turn out to be less intensive. On the other hand, a relaxation of the composite yarn must be limited, so that any interference with the method is avoided. In contrast thereto, the takeup speed must be selected to be sufficiently high so that neither very soft, instable, and unusable packages, nor intolerably hard packages with yarn damages are produced.

Figure 5:
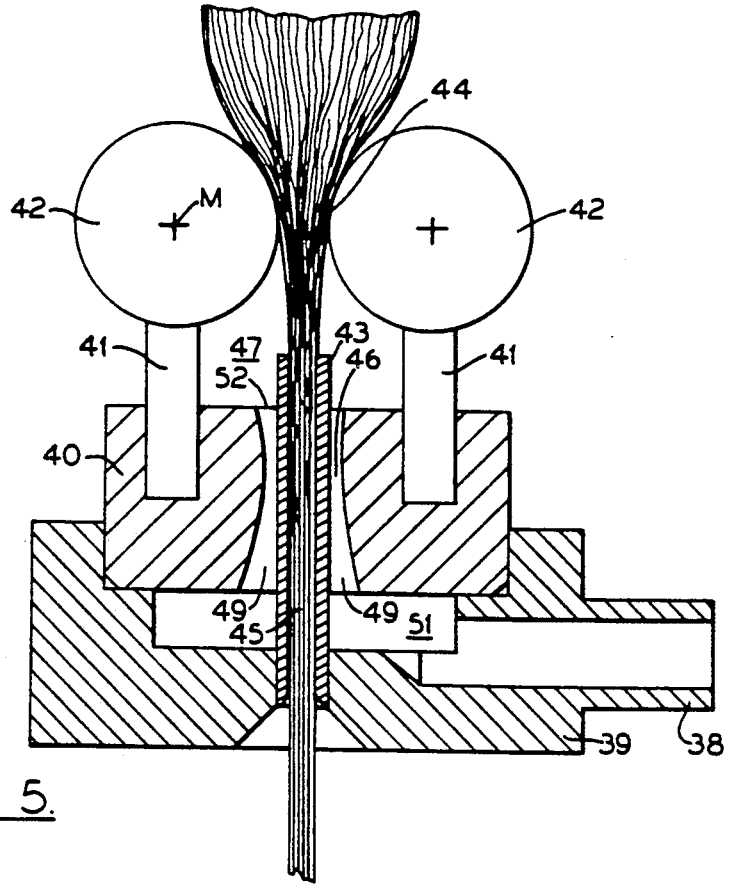
FIG. 5 is a sectional view of a spreading nozzle adapted for use with the present invention.

Shown in FIG. 5 is a longitudinal sectional view of a suitable spreading nozzle 32, which can be used in the method of FIG. 2 or 3. As illustrated, the nozzle comprises a yarn tube 43 which is mounted with its lower end in a block 39. A compressed air connection 38 terminates in a collecting chamber 51, which in turn leads to two compressed air channels 49 which are formed in an upper block 40. The two compressed air channels extend along the outer circumference of the yarn tube, their diameter being smaller than that of the yarn tube. The inner boundary of the compressed air channels is formed by the outside wall of the yarn tube. The compressed air channels are diametrically opposite to each other with respect to the yarn tube. The outer walls of the compressed air channels are convergent with respect to the axial direction of the yarn tube and form a cross section with a minimum width 46.

Two balls 42 are mounted on posts 41 which are fixed to the upper block 40, so as to define a narrow gap 44 which is located between the balls 42 and which is above the outlet of the yarn tube 43. The channels 49 exit into the open space below the balls 42. Both the channels and the yarn tube 43 are aligned with the gap 44. The yarn tube 43 and the two compressed air channels 49 are arranged, together with the centers M of two balls 42 in a plane, in which the continuous yarn is guided and spread to open its individual filaments. Thus in operation, the air exiting the channels 49 is directed to the gap 44, and the air tends to smoothly adhere to the surface of the two balls. Thus the balls cause a spreading action of the air, which in turn spreads the filaments which are entrained in the air stream.

In the drawings and specification, there has been set forth a preferred embodiment of the invention, and although specific terms are employed, they are used in a generic and descriptive sense only and not for purposes of limitation.

That which is claimed is:

1. A method for combining a relatively elastic yarn component with a relatively inelastic yarn component composed of yarn filaments, and so as to produce a bulked composite yarn, and comprising the steps of, advancing each of the yarn components along respective paths of travel, and including withdrawing the elastic yarn component from a supply package, while spreading the filaments of the advancing inelastic yarn component, and then guiding the advancing components through a jet of high velocity fluid so that the jet impinges on the two components and entangles the filaments and combines the two yarn components to form a composite yarn, and wherein the speed of the resulting composite yarn immediately following its being guided through said jet of high velocity fluid is substantially greater than the speed at which the elastic yarn component is withdrawn from its supply package.

2. The method as defined in claim 1 wherein the advancing step includes bringing the two advancing components together, and the spreading step occurs prior to the step of bringing the advancing yarn components together.

3. The method as defined in claim 2 wherein the spreading step includes drawing the advancing inelastic yarn component over an edge surface while applying tension thereto.

4. The method as defined in claim 2 wherein the spreading step includes passing the advancing inelastic yarn component through an air nozzle.

5. The method as defined in claim 1 wherein the advancing step includes bringing the two advancing components together, and the spreading step occurs subsequent to the step of bringing the advancing yarn components together.

6. The method as defined in claim 5 wherein the spreading step includes passing the two yarn components through an air nozzle.

7. The method as defined in claim 1 wherein the elastic yarn component and the inelastic yarn component are both composed of yarn filaments, and wherein the advancing step includes bringing the two advancing components together, and the spreading step occurs subsequent to the step of bringing the two advancing components together and so that the filaments of both yarn components are spread.

8. The method as defined in claim 2 wherein the spreading step includes false twisting the advancing inelastic yarn component and then removing the false twist.

9. The method as defined in claim 8 wherein the advancing inelastic yarn component is advanced under a tension of between 0.3 to 0.8 cN/dtex during the false twisting step.

10. The method as defined in claim 9 wherein the elastic yarn component is subjected to a tension of between about 0.1 to 0.4 cN/dtex when it is brought together with the inelastic yarn component.

11. The method as defined in claim 1 including the further step of withdrawing the resulting composite yarn from the jet of high velocity fluid at a speed which is at least about 2% lower than the speed at which the two yarn components advance to the jet.

12. The method as defined in claim 11 including the further subsequent step of winding the withdrawn composite yarn into a package.

13. The method as defined in claim 1 wherein the step of guiding the advancing components through a jet of high velocity fluid includes directing the jet so as to blow against the yarn components in a direction transverse to their direction of advance and with a component of the jet direction lying in the direction of the advancing components.

14. The method as defined in claim 1 wherein the elasticity of the elastic yarn component is at least about ten times that of the inelastic yarn component.

15. A method for combining a relatively elastic yarn component with a relative inelastic yarn component composed of yarn filaments, and so as to produce a bulked composite yarn, and comprising the steps of, advancing each of the yarn components along respective paths of travel, while false twisting the advancing inelastic yarn component and so as to spread the filaments transversely to the axis of the inelastic yarn component, and then removing the false twist, said false twisting step including heating the advancing inelastic yarn component and then cooling the same, and then guiding the advancing components through a jet of high velocity fluid so that the jet impinges on the two components and entangles the filaments and combines the two yarn components to form a composite yarn.

16. The method as defined in claim 15 wherein the step of advancing the elastic yarn component along its path of travel includes withdrawing the same from a positively driven supply package.

17. The method as defined in claim 16 including the further subsequent step of positively withdrawing the resulting composite yarn from the fluid jet at a speed at least about twice the speed at which the elastic yarn component is withdrawn from its supply package, and then winding the composite yarn into a package.

18. The method as defined in claim 15 wherein the step of guiding the advancing components through the jet of high velocity fluid includes guiding the components through a nozzle wherein the jet impinges on the two components, and wherein the advancing step includes maintaining the components separated from each other until after or immediately before they enter the nozzle.

19. The method as defined in claim 18 wherein the two yarn components are guided into said nozzle at about the same entering speed and wherein the yarn components are withdrawn from said nozzle at a speed about 6% to 9% lower than the entering speed.

20. The method as defined in claim 15 wherein the elastic yarn component comprises one or more spandex filaments, and the elasticity of the elastic yarn component is at least about ten times that of the inelastic yarn component.

21. The method as defined in claim 15 wherein the advancing inelastic yarn component is advanced under a tension of between 0.3 to 0.8 cN/dtex during the false twisting step, and wherein the elastic yarn component is subjected to a tension of between about 0.1 to 0.4 cN/dtex when it is brought together with the inelastic yarn component.

22. A method for combining a relatively elastic yarn component with a relatively inelastic yarn component composed of yarn filaments, and so as to produce a bulked composite yarn, and comprising the steps of, advancing each of the yarn components along respective paths of travel, and including bringing the two advancing components together, while spreading the filaments of the advancing inelastic yarn component, and wherein the spreading step occurs subsequent to the step of bringing the advancing yarn components together, and then guiding the advancing components through a jet of high velocity fluid so that the jet impinges on the two components and entangles filaments and combines the two yarn components to form a composite yarn.

23. The method as defined in claim 22 wherein the spreading step includes passing the two yarn components through an air nozzle.

24. A method for combining a relatively elastic yarn component with a relatively inelastic yarn component composed of yarn filaments, and so as to produce a bulked composite yarn, and wherein the elastic yarn component and the inelastic yarn component are both composed of yarn filaments, and comprising the steps of, advancing each of the yarn components along respective paths of travel, and including bringing the two advancing components together, while spreading the filaments of the advancing inelastic yarn component, and wherein the spreading step occurs subsequent to the step of bringing the two advancing components together and so that the filaments of both yarn components are spread, and then guiding the advancing components through a jet of high velocity fluid so that the jet impinges on the two components and entangles the filaments and combines the two yarn components to form a composite yarn.

25. A method for combining a relatively elastic yarn component with a relatively inelastic yarn component composed of yarn filaments, and so as to produce a bulked composite yarn, and comprising the steps of, advancing each of the yarn components along respective paths of travel, and including bringing the two advancing components together, while spreading the filaments of the advancing inelastic yarn component, and including false twisting the advancing inelastic yarn component and then removing the false twist, and wherein the spreading step occurs prior to the step of bringing the advancing yarn components together, and then guiding the advancing components through a jet of high velocity fluid so that the jet impinges on the two components and entangles the filaments and combines the two yarn components to form a composite yarn, and wherein the advancing inelastic yarn component is advanced under a tension of between 0.3 to 0.8 cN/dtex during the false twisting step.

26. The method as defined in claim 25 wherein the elastic yarn component is subjected to a tension of between about 0.1 and 0.4 cN/dtex when it is brought together with the inelastic yarn component.

* * * * *